United States Patent [19]

Heyl

[11] Patent Number: 4,665,839

[45] Date of Patent: May 19, 1987

[54] DEPOSITORY

[75] Inventor: Leo W. Heyl, Cincinnati, Ohio

[73] Assignee: Mosler, Inc., Hamilton, Ohio

[21] Appl. No.: 808,604

[22] Filed: Dec. 13, 1985

[51] Int. Cl.[4] ..... E05G 1/06; E05G 5/00

[52] U.S. Cl. ..... 109/24.1; 109/47; 109/55; 109/66; 232/43.3

[58] Field of Search ..... 109/66, 55, 46, 47, 109/68, 24.1; 232/43.1, 43.3, 16, 15, 44; 414/648

[56] References Cited

U.S. PATENT DOCUMENTS

| | | | |
|---|---|---|---|
| 1,759,129 | 5/1930 | McClintock et al. | 109/47 |
| 2,617,584 | 11/1952 | Behrens . | |
| 3,059,839 | 10/1962 | Graber . | |
| 3,465,955 | 9/1969 | De Boer et al. . | |
| 3,615,050 | 10/1971 | Deaton et al. | 232/43.3 |
| 3,836,980 | 9/1974 | Grosswiller et al. . | |
| 3,897,901 | 8/1975 | Grosswiller et al. . | |
| 4,038,523 | 7/1977 | Widmer et al. . | |
| 4,063,520 | 12/1977 | Parsons . | |
| 4,085,687 | 4/1978 | Beck et al. . | |
| 4,176,610 | 12/1979 | Markham et al. . | |
| 4,308,804 | 1/1982 | Guibord et al. . | |

*Primary Examiner*—Alfred C. Perham
*Attorney, Agent, or Firm*—Wood, Herron & Evans

[57] ABSTRACT

Disclosed is a depository wherein the deposit envelope is conveyed in an enclosed carrier from a deposit opening along an attack resistant passage to a remote opening to a vault. There a wall of the carrier moves, relative to the carrier, to displace the deposit from the carrier into the vault. External access to the vault is protected by both the walls of the passage and the carrier, as well as by the vault walls.

27 Claims, 10 Drawing Figures

DEPOSITORY

FIELD OF THE INVENTION

This invention relates to a so-called "depository", that is, an unattended or free-standing safe or vault with means for depositing cash or other valuables without the assistance of a teller, and wherein the deposited items are protected against theft until they are removed by the bank or other attendant.

BACKGROUND

Depositories are commonly used to provide "round the clock" deposit facilities so that cash or checks or the like can be deposited at times when a bank is closed. Indeed, their convenience is such that they are often used even when the banks are open. They may be installed adjacent a bank or at a separate location. It is a fundamental requirement of such devices that they be simple, foolproof, virtually automatic in operation, and resist outside attack for a specified minimum period of time dependent upon specific use.

PRIOR ART

The basic structure of virtually any depository includes a customer or deposit opening into which an envelope or bag containing the deposit can be inserted, means transporting the deposit from the deposit opening to a protected vault, and means releasing or placing the deposit in the vault in a manner which renders the contents of the vault inaccessible from the deposit opening.

Prior depositories can be roughly categorized into the following general types:

(1) Belt conveyor type depositories wherein the deposit is moved by one or a pair of endless driven belts which carry it horizontally rearward into a vault. Apparatus representative of this type are shown in Grosswiller U.S. Pat. No. 3,836,980; Beck U.S. Pat. No. 4,085,687; and Guibord U.S. Pat. No. 4,308,804.

(2) Rotatable cylinder type depositories wherein the deposit is placed in a sectionalized or split cylinder or drum which is then rotated approximately 180° about a horizontal axis to drop the envelope into a vault, the cylinder continually blocking direct communication between the deposit opening and the vault. Representative patents showing this type of construction are Graber U.S. Pat. No. 3,059,839; Grosswiller U.S. Pat. No. 3,897,901; and Widmer U.S. Pat. No. 4,038,523.

(3) Hinged floor type depositories wherein the deposit is placed on a hinged floor which is then tilted or turned, relative to the door, to sweep the deposit into a vault. Representative of this type are Behrens U.S. Pat. No. 2,617,584; DeBoer U.S. Pat. No. 3,465,955; Parsons U.S. Pat. No. 4,063,520; and Markham U.S. Pat. No. 4,176,610.

In many prior depositories the mechanism for inserting the deposit in the vault has essentially been an external "add on" to the vault. That is, the deposit mechanism has been unprotected, or only poorly protected, and has not afforded real protection to the vault itself. Such depositories have in some cases have been successfully attacked by attaching a truck or jack to the depositing mechanism and physically pulling it away from the vault, which then stands relatively unprotected. The vault can then be "fished" through its opening, and deposits removed by a hook or the like.

So far as is known, no one has proposed a depository wherein the deposit is inserted through a door into an attack resistant, enclosed movable compartment or carrier which carries the deposit either vertically or horizontally to the end of a shaft or passage, whereat the floor or wall of the carrier is then moved to sweep the deposit out of the carrier, past a barrier and into a vault.

BRIEF DESCRIPTION OF THE INVENTION

In accordance with this invention, the depository comprises a movable carrier for receiving an envelope or other deposit which can be inserted into the carrier through a door. The carrier is movable in a protected passage or shaftway, between a starting or deposit insert position in which it is accessible through the door, and a "dump" position to which the carrier is removed along the passage so as to be inaccessible from the door. Carrier moving means are provided for moving the carrier along the passage between the two positions. A vault is provided for receiving a deposit dropped into it from the carrier in the passage, when the carrier is at the dump position. The vault wall or other barrier (of steel plate or other attack-resistant material) blocks communication between the door and the interior of the vault. The vault has an opening which communicates with the passage, so that the barrier does not block movement of the deposit from the carrier when the carrier is at the dump position into the vault. Means are provided for moving a wall or floor of the carrier at the dump position to displace the deposit from the carrier, past the barrier or through the vault opening, and into the vault.

A preferred embodiment of the invention involves two doors which must be opened sequentially, including an outer door in an attack resistant housing which enclose both the passage and vault, and an inner door built into and moving with the carrier. After the deposit has been placed in the carrier and both doors have been closed, the carrier is lifted up a vertical shaftway to the dump position. At the dump position, the carrier is stopped adjacent an opening to the vault. As this occurs, the floor of the carrier (on which the deposit rests) is swung or moved to flip or drop the deposit through the vault opening, from which it falls into the vault below. The carrier floor remains in vertical position while the carrier is returned to its initial position, and as this occurs the floor surface passes closely to or is "scraped" by the edge of the vault opening so that the latter positively removes any deposit, thereby insuring that the deposit falls into the vault. The floor is returned to horizontal position as the carrier returns to its initial position adjacent the outer door.

DESCRIPTION OF THE DRAWINGS

The invention can best be further described by reference to the accompanying drawings, in which:

FIGS. 1–5 comprise a series of diagrammatic vertical sections of the door and carriage portion of a preferred form of depository in accordance with the invention, showing the sequence of movement involved in a deposit cycle, wherein:

FIG. 1 shows the carrier in its initial condition, with both doors closed;

FIG. 2 shows the carrier in deposit receiving position, with the outer and inner doors both open;

FIG. 3 shows the carrier as it is being moved vertically, with both doors closed;

FIG. 4 shows the carrier at its dump position whereat the floor of the carrier has been raised and the deposit envelope has dropped into the vault; and FIG. 5 shows the carrier being returned to the start position with the carrier floor being returned to horizontal for a subsequent cycle;

DETAILED DESCRIPTION

Figures 1, 2, 3, 4, 5:
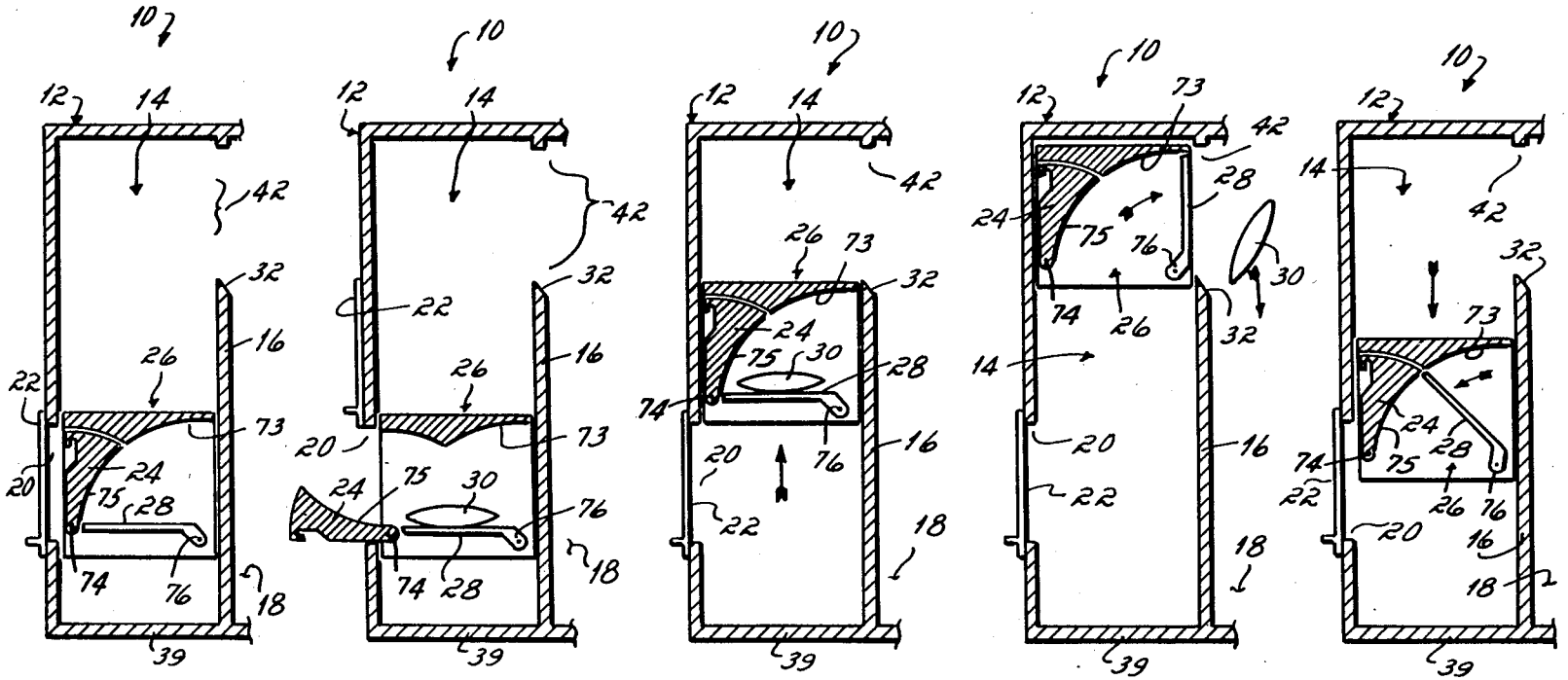

The basic components and operation of the invention are most easily first described by reference to FIGS. 1-5. The entire depository 10 is housed within an attack-resistant housing 12, preferably of plate steel, comprising a forward portion defining a carrier passage, shaftway or compartment 14 which is separated from a rearward vault 18 by an intermediate barrier or vault wall 16.

The housing presents a customer opening 20 in its outer wall, which is closed by an outer door 22. A traveling inner door or gate 24 is mounted to and travels with a movable carrier or cage 26. In the preferred embodiment door 22 is vertically slidable and must be opened before the inner door or gate 24 can be opened. Carrier 26 is mounted (by means not shown in FIGS. 1-5) for vertical movement in shaft 14, between a starting position shown in FIG. 1 and a dump position shown in FIG. 4, in which it is remote from outer door 22, above the upper end of the barrier or wall 16. Outer door 22 is raised and inner door 24 is swung open so that the deposit envelope can be inserted. Carrier 26 has a movable or swingable floor, tray or partition 28 on which an envelope or other deposit 30 can be placed through the doors. After the deposit has been placed in the carrier, door 24 is closed and outer door 22 is returned to closed position before the carrier starts its travel to the dump position. When carrier 26 has been shifted or elevated by means to be described to the dump position, floor 28 is lifted to vertical position so that it displaces deposit 30 from carrier 26; the deposit falls through vault opening 42 above the upper edge 32 of barrier 16, dropping into vault 18 below. The interior side of carrier door 24 is curved about the axis of rotation of floor 28, so that the entire interior of the carrier is "swept" or cleared when the floor is raised. After dumping, the carrier is automatically moved reversely, toward the insert position, while floor 28 is returned to normal or horizontal attitude (FIG. 5).

Given this overall description, the details of the preferred form of the invention illustrated in the drawings is next set forth. The depository is shown as a "stand-alone unit," not enclosed within a bank vault but with its own separate vault protection. In the embodiment shown, the depository is mounted within a building wall 36. The reinforced housing 12 comprises a steel plate front, top and bottom, 38*a,b,* and *c* respectively, and opposite sidewalls, one of which is shown at 38*d.* Housing 12 is provided with a hinged vault access door 40 at the rear.

Figure 6:
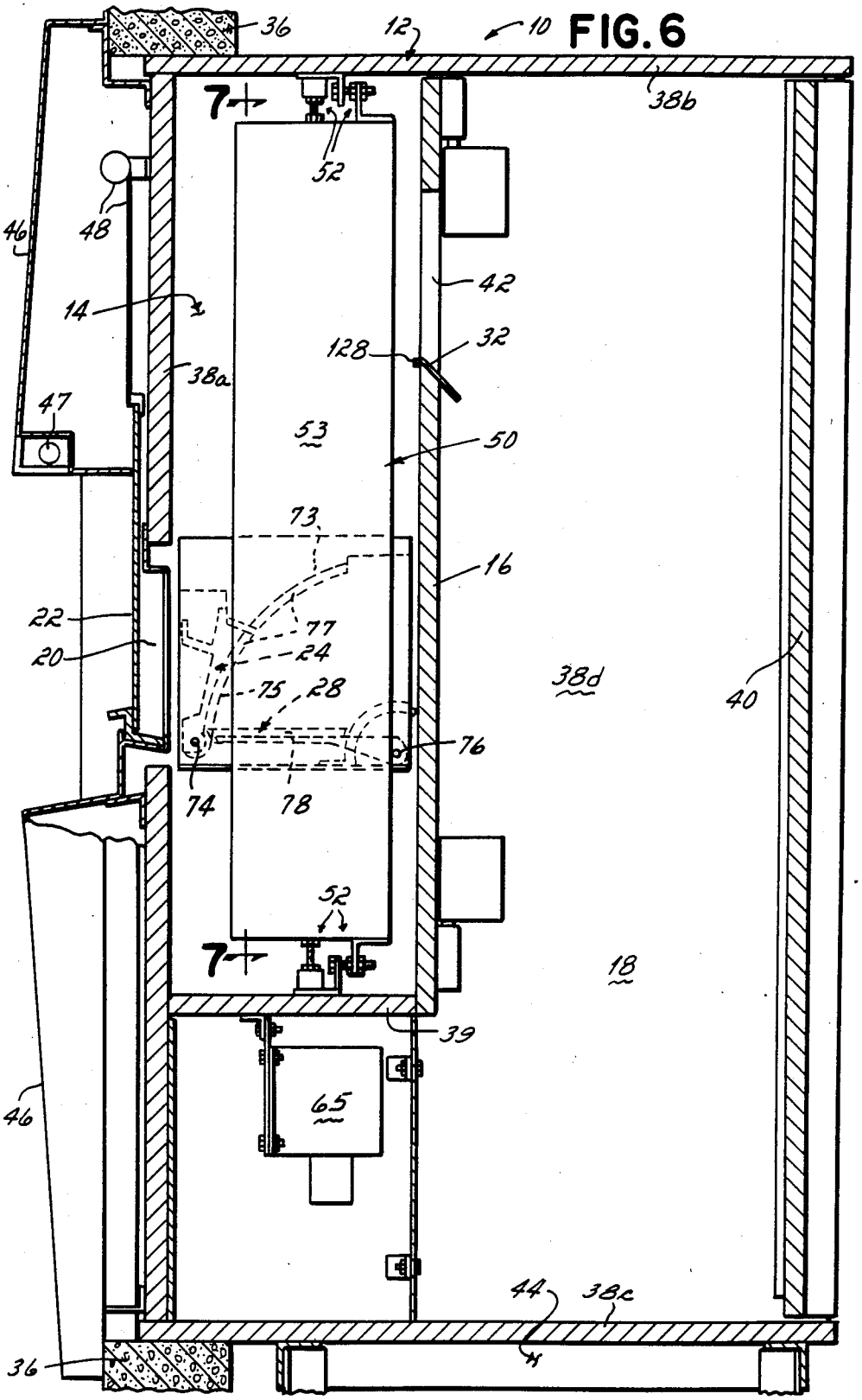
FIG. 6 is an enlarged fragmentary vertical section, partly diagrammatic in nature, of the carrier and vault portions of the depository, with the insert opening closed and the carrier shown in phantom lines in its starting position.

As seen in FIG. 6, vault wall or barrier 16 is itself hinged to a sidewall 38*d* so that it can be opened for access to shaft compartment 14 for service. It can be seen that vault 18 is protected on all sides by steel-plate, suitably ¾ inches thick, and that entry to vault 18 from customer opening 20 is blocked by the doors 22 and 24, carrier 26, and compartment wall 16. Vault opening 42, which opens from compartment 14 to vault 18, is remote from customer opening 20 and will always be blocked at least by carrier 26. To resist attack, the carrier may have a hardened or heat dissipating floor, walls, and/or ceiling.

In the usual installation housing 12 will be supported on a substructure indicated generally at 44, which may be a concrete footing or other foundation below grade.

The front of housing 12 mounts a decorative facade which may be a sheet metal or other facing 46. The outer door 22 is mounted and guided for vertical sliding movement relative to customer opening 20. This door may be of relatively light construction, as its primary function is to provide a closure before carrier motion starts. Lifting of door 22 is assisted by a negator spring 48. Facing 46 may mount a light 47.

Figure 7:
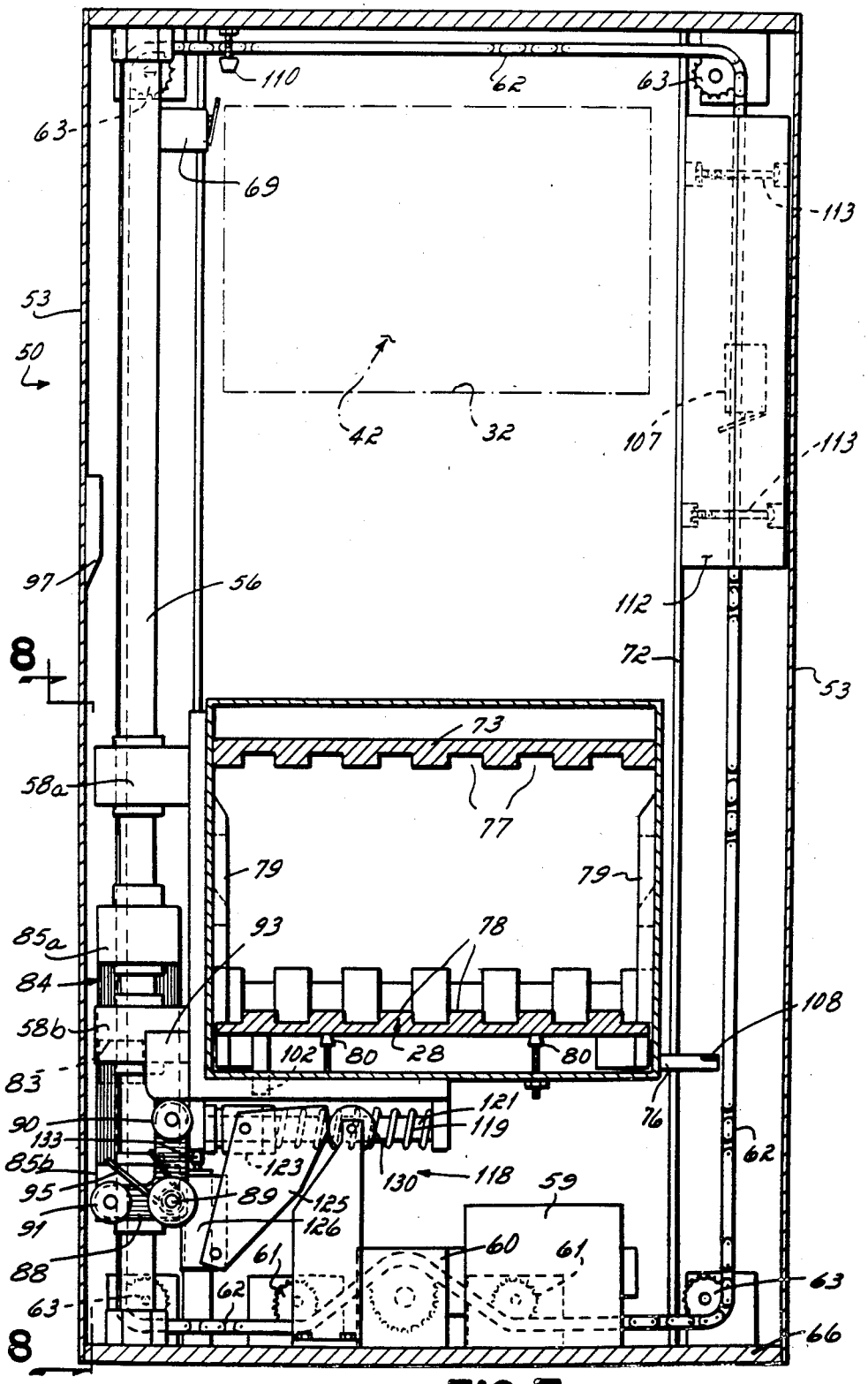
FIG. 7 is a further enlarged vertical section taken on line 7—7 of FIG. 6, of the carrier and the associated lifting and guide structure.

Carrier 26 is mounted within a carrier assembly designated generally by 50, which can be positioned as a unit in shaft 14 between front wall 38*a* and a vault barrier 16. So that the carrier can be accurately positioned and fixed in position, assembly 50 is provided with mounting jacks 52 at the top and bottom, which bear against the housing top plate 38*b* and the shaft bottom plate 39 (FIG. 6). Similar jacks not shown are also provided on each side of the carrier assembly. Details of the assembly are best seen in FIG. 7; its purpose is to transport the carrier between the insert position and the dump position, and to flip or tilt carrier floor 28 to drop the deposit through the vault opening 42.

The carrier assembly is mounted in a relatively light casing 53, since the principal protection is provided by the heavy steel plate walls around it. A vertical carrier guidepost 56 extends between the top and bottom walls of carrier casing 53, and carrier 26 is cantilever-mounted for movement on guidepost 56. Carrier guide arms 58*a* and *b,* fixed to one side of the carrier, are received for rolling and/or sliding movement on guidepost 56. The carrier is moved upwardly and downwardly along post 56 by a motor 59 which, through a gear reducer 60 and idler gears 61, 61, drives a link drive chain 62. Chain 62 moves around a generally rectangular path defined by four sprockets, each designated at 63, adjacent the corners of carrier assembly casing 53. Sequencing of carrier motor operation is governed by a motor controller 65, see FIG. 6, mounted below shaft bottom plate 39.

A microprocessor (not shown) may be provided to monitor and control operation of the system, for example, to prevent the outer door from being opened unless the carrier is at insert position, and so that the motor will not start until the outer door and the carrier door have both been closed. The programming of the microprocessor itself is not part of this invention.

Figure 8:
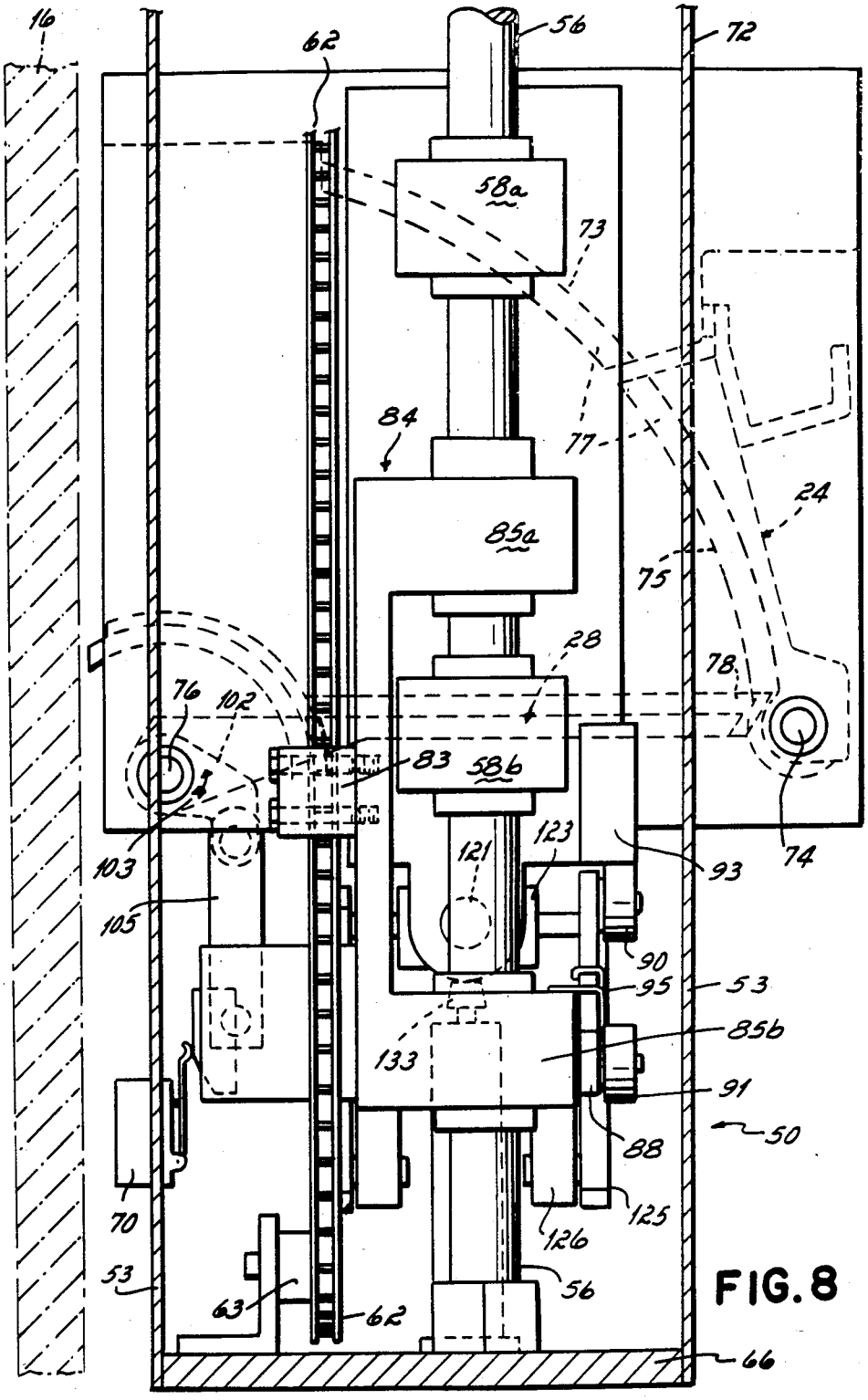
FIG. 8 is a further enlarged vertical section taken on line 8—8 of FIG. 7, showing the relative positions of the components when the carrier is in the insert position.

Arrival of the carrier at its uppermost or dump position (shown in FIG. 9) actuates an upper limit switch 69 (best seen in FIG. 7) which signals the controller; in its lowermost position, a lower limit switch 70 is actuated (see FIG. 8). Upon actuation, switch 69 causes the direction of rotation of motor 59 to be reversed, so that carrier 26 is returned to starting position; the bottom limit switch 70, upon actuation, stops motor 59 when the carrier is in this position.

Because post 56 is cylindrical, carrier 26 might tend to rotate about it. Such rotation is prevented by a vertical guide bar 72 which prevents a lateral swinging motion of the carrier.

Details of the carrier are best seen in FIGS. 7 and 8. It comprises a generally rectangular box-like structure, and mounts inner door 24 at its front. Door 24 is hinged to rotate on a horizontal axis or pivot 74, adjacent the carrier floor. As seen in FIG. 6, door 24 presents a curved inner surface 75; this surface forms an arc or a portion of a cylinder centered along an axis 76 at the lower back edge of the carrier. Carrier floor 28 is pivoted about this same axis 76 and is so dimensioned that, as the floor is raised, its front edge sweeps close to the door inner surface 75, so as to displace the deposit and prevent it from being lodged or slipping between the door and the edge of the floor. To clear the carrier most effectively, it is desirable that the door inner surface 75 and ceiling 73 be circumferentially ribbed or splined as best shown at 77 in FIG. 7, and that the floor have ribs, the outer ends of which closely interfit with and slide in mating grooves 78 in the door surface as the door is raised. Arcuate grooves 79 formed in the sidewalls of the carrier similarly cooperate with bosses projecting from the lateral edges of the floor, to dislodge any deposit which might have become stuck at the side.

Floor stops 80 set the horizontal or rest position of the floor.

The means by which the drive movement of chain 62 is transmitted to the carrier and to the floor, to move the carrier and tilt the floor within the carrier, is shown in FIGS. 7–10. A chain clamp block 83 secures the chain to a traveling yoke 84 which has spaced apart legs 85*a* and *b*, each of which are slidably journaled on post 56. The yoke legs 85*a* and *b* straddle a carrier guide arm 58*b*, see FIG. 8. The yoke moves with the chain at all times; the carrier does not. Upward chain movement is transmitted through the yoke to the carrier by an L-shaped lever designated generally at 88 and best shown in FIG. 10. Lever 88 is centrally pivoted at 89 to yoke leg 85*b*, and mounts cam rollers 90 and 91 at its opposite ends. Depending upon the angular position of lever 88 about pivot 89, the upper cam roller 90 is either engaged beneath a carrier lift block 93 on the carrier (see FIG. 8), so as to lift the carrier, or rides on the side surface of block 93, see FIG. 10, in which position it does not lift the carrier.

Figure 10:
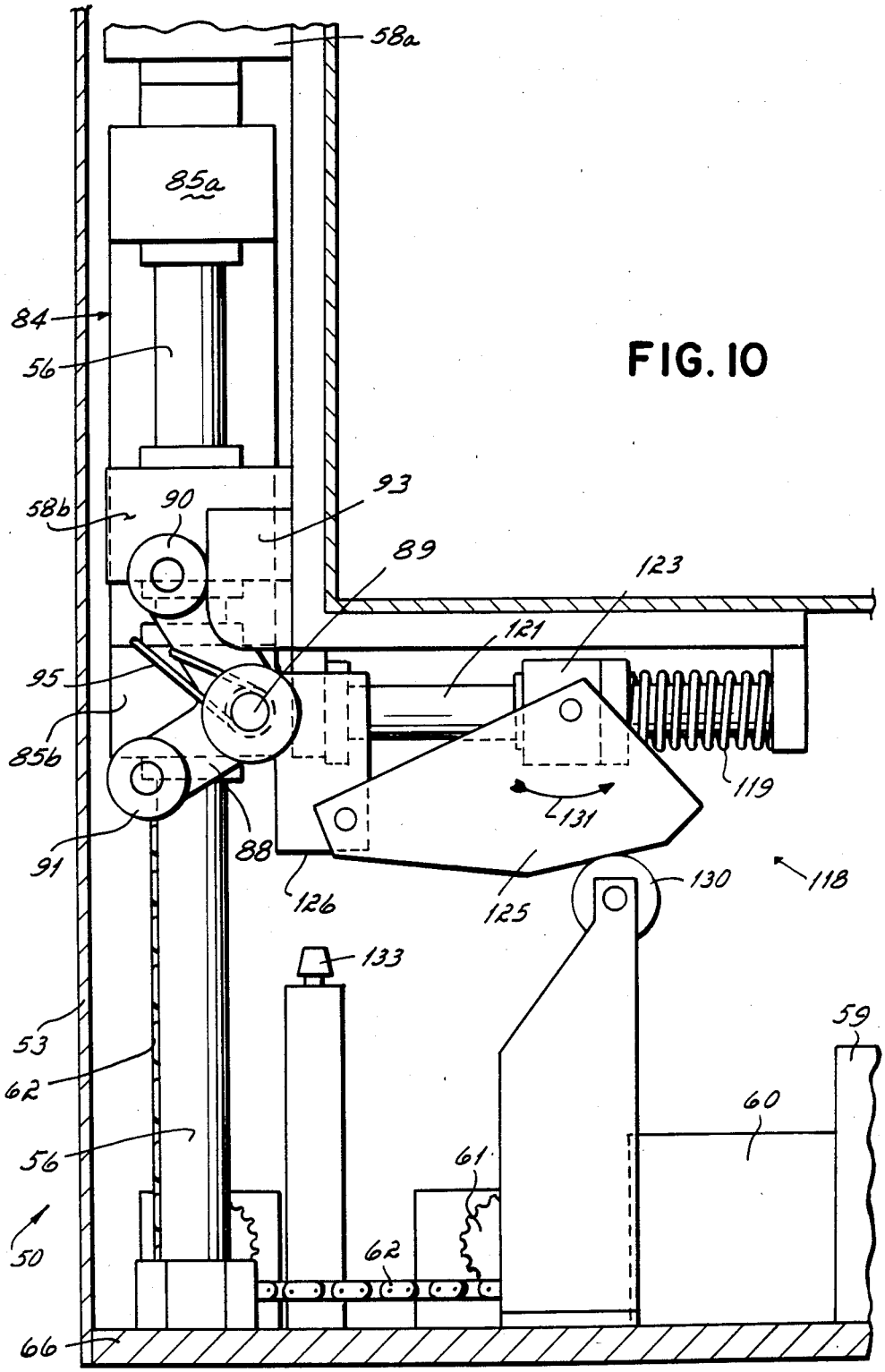
FIG. 10 is an enlarged vertical cross section showing operation of the cushioning or biasing means as the floor is lowered and the carrier is returned to insert position.

A lever spring 95 biases the lever in the clockwise direction as seen in FIG. 10, that is, it tends to move the upper cam roller toward block 93. Lower cam roller 91, at the other end of lever 88, is engageable with a fixed cam 97 (see FIG. 7) mounted on the carrier assembly wall adjacent the path of travel of roller 91. As will be explained, when the carrier is being lifted, chain 62 lifts yoke 84, including lever 88. During this lift part of the cycle lever 88 is in the position shown in FIG. 7, in which it bears against the bottom of lift block 93, in lifting relation so that it transmits upward movement from the chain to the carrier.

When the projecting lower roller 91 hits a floor flipper cam 97, lever 88 is swung about its pivot (in the counterclockwise direction in FIG. 7), swinging upper roller 90 out from below block 93 so that the roller thereafter bears upon the more nearly vertical side surface of block 93 (see FIG. 10). In this attitude roller 90 ceases to exert a positive lifting force on the carrier, and the carrier stops moving with the chain, or drops on post 56, until upwardly moving yoke leg 85*a* abuts guide arm 58*a* (see FIG. 9). As this occurs the chain and yoke are moving relatively upward relative to the carrier. This relative upward movement is used to flip the floor, that is, to bring it quickly from horizontal position to vertical position so that any deposit on it will be tossed or dumped into the vault.

This dumping movement begins as the floor is passing the lower end 32 of vault opening 42 (see FIG. 9), and the carrier is opposite opening 42. As chain 62 moves upwardly relative to the carrier, its relative movement is transformed to a rotary motion to turn the floor. This is effected by a link and crank mechanism shown in FIG. 9. A crank 102 is connected to floor 28 so that when the crank is turned in the counterclockwise direction indicated by arrow 103, the floor is swung to vertical position. A link 105 is pivotally connected between an extension of yoke 84 and crank 102, so that it swings the outboard end, the right end in FIG. 9, of crank 102. This turns the lever and flips the floor to the vertical position.

Figure 9:
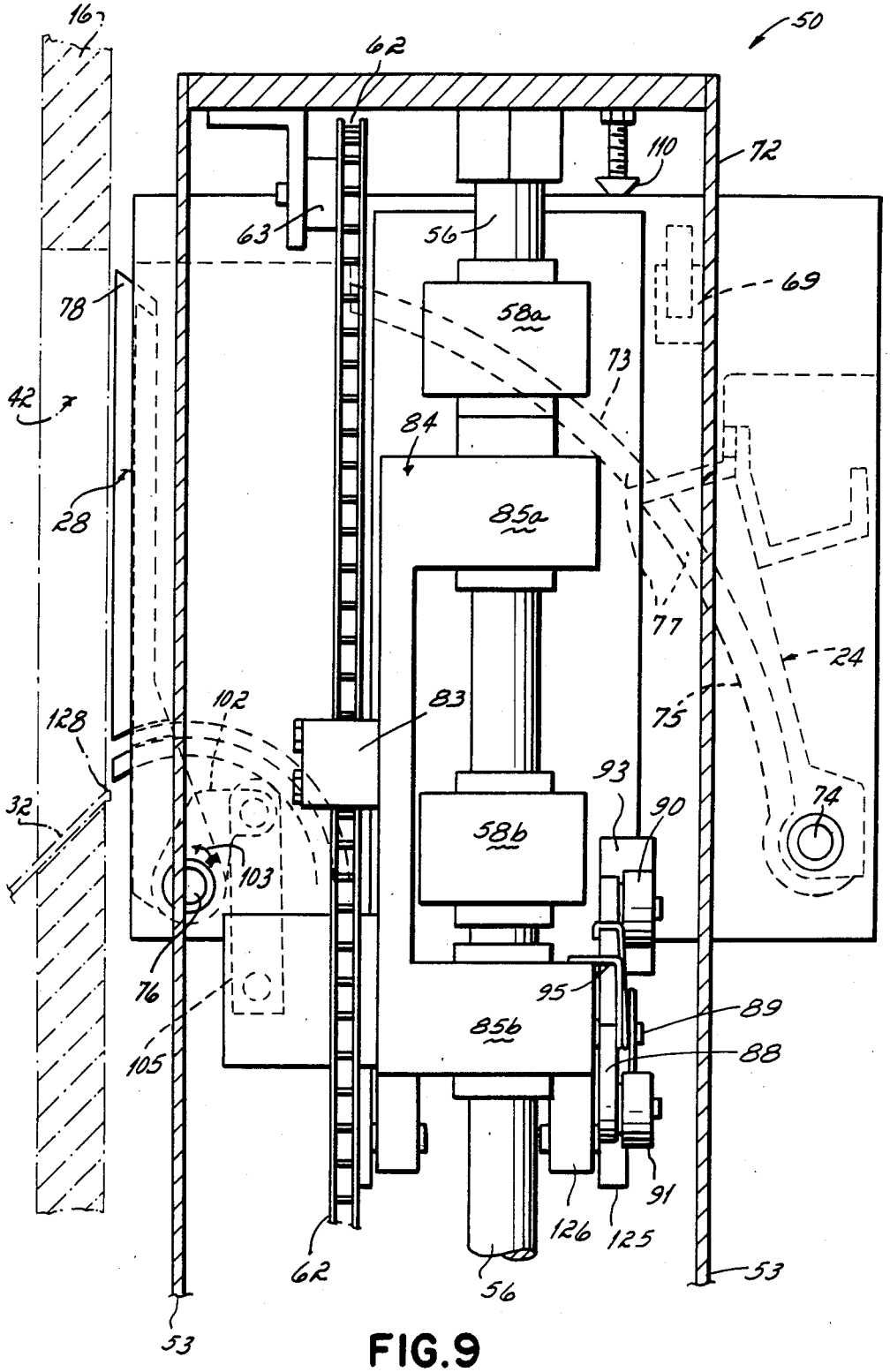
FIG. 9 is a diagrammatic vertical section similar to FIG. 8 but showing the relative positions of the elements when the carrier is stopped at the dump position and the floor has been raised.

A microswitch 107 (FIG. 7) is positioned to be engaged by a microswitch-engaging finger 108 connected to floor 28 when the floor is in the raised position of FIG. 9. This switch provides a signal which stops motor 59. A mechanical stop 110 positively limits the upward travel of carrier 26 at the top of the housing.

It will be noted in FIG. 7 that the weight of carrier 26 is counterbalanced by a weight 112 which is attached to chain 62 as by bolts 113; as the carriage moves up, the weights move down.

Means are provided to cushion or soften the movement of floor 28 into the vertical position. This preferably comprises a spring compression means designated generally at 118 (see FIGS. 7 and 10), whereby a coil spring is compressed as the floor is swung into vertical position. The rate of the spring is such that it gradually slows the movement of the chain to avoid an abrupt impact when the floor reaches the vertical limit of its travel.

Specifically, cushioning means 118 includes a coil spring 119 carried on a spring-retaining shaft 121, which is mounted by brackets secured to the underside of carrier 26. A collar 123 is slidable on shaft 121. When the collar is in the rightmost position, as shown in FIG. 10, spring 119 is compressed; when the collar is in the leftmost position, as shown in FIG. 7, the spring is relatively uncompressed. A spring cam 125 is pivotally connected between collar 123, and an extension 126 of yoke 84. Relative movement between the yoke and carrier compresses or decompresses the spring during upward and downward travel, respectively, of the carrier. Thus, when lever 88 releases the lifting force on the carrier and yoke 84 and pivot 89 move upward relative to carrier 26 and collar 123, this upward movement causes cam 125 to pivot in the clockwise direction about the pivot on collar 123. This shifts the collar rightward on shaft 121 and compresses the spring; such compression of the spring gradually slows the upward movement of the carrier and the turning movement of the floor.

The controller is desirably programmed for a short dwell when the carriage is at dump position and the floor has been raised to vertical position, to enable the deposit to drop from the floor. The direction of rotation of the motor is then reversed to convey the carrier downwardly. Floor 28 remains in the vertical position for most of the downward travel of the carrier, and as the carrier moves downwardly the floor is "wiped" by projections on a wiper 128 secured to the vault opening ledge 32. This insures that any deposit will be physically stripped from the floor and will fall into the vault.

During downward travel of the carrier, roller 90 remains in the position shown in FIG. 10, and does not exert a supporting force on the carrier; the carrier arm or arms rest on the yoke as it moves downwardly. As the carrier nears its starting position, spring cam 125 engages a spring cam roller 130 which is mounted above the carrier assembly bottom plate 66. Roller 130 engages cam 125 at a position thereon which tends to rotate the cam counterclockwise about its pivot to collar 123, as indicated by arrow 131 in FIG. 10. The chain continues to move downwardly as spring 119 expands and shifts the collar leftward. The inefficient shape of the cam stabilizes the movement of the carrier as this occurs. As the chain moves downward relative to the slowing carrier, roller 90 also moves downward relative to lift block 93 to its initial position beneath the block as seen in FIG. 7, and it snaps clockwise around its pivot 89 back into the lift position for the next cycle.

As the foregoing is occurring, the carrier floor is restored to horizontal position by relative downward movement of the chain and yoke from the carrier. As yoke 84 moves downwardly away from carrier 26 to the FIG. 8 position from the FIG. 9 position, it can be seen that link 105 turns crank 102 clockwise, swinging the floor down again. Movement of the yoke to its downwardmost position is sensed by microswitch 70, see FIG. 8, which stops the motor. A stop 133 physically abuts the yoke and sets the lower limit of carrier travel.

By way of additional operating and safety features, it is contemplated that the depository may be responsive to a magnetic or other type of user's card, which must be inserted in order for outer door 22 to be opened. Such card reading mechanisms are well known per se and do not comprise the invention. When the card is inserted and read, a solenoid lock is energized, thereby unlocking outer door 22 so that it can be raised manually. When the door is raised a solenoid controlled detent holds the outer door in the raised position while the inner door is opened, so that the deposit can be placed into the carrier. When the inner door has been closed again, the outer door is slid down, which in turn starts operation of the chain drive motor. Operation of the motor is desirably interlocked to the outer door so the outer door cannot be opened when the motor is operating.

From the foregoing it will be seen that the carrier always blocks access from the customer opening 20 to the vault opening 42. To prevent attack on the carrier itself, its bottom, walls, and/or top may be reinforced with heat dissipating or drill-resistant plate means. Should an opening be gained past the carrier, a conventional notched "fish hook" catcher plate overhanging the vault will catch any fishing devices and prevent them from being pulled back past it.

In the embodiment just described, the path of carrier travel is vertical. It is also contemplated that the carrier can alternatively travel horizontally or diagonally to the vault. In horizontal configuration the carrier need not be lifted, as a result of which its weight is not so important and the carrier can be fabricated from heavier material, without counterbalancing.

Having described the invention, what is claimed is:

1. A depository comprising, a housing, a door, a carrier for receiving a deposit inserted into it through said door, said carrier being movable in a shaftway in said housing, between a deposit insert position in which it is accessible through said door, and a dump position in which it is remote from said door, means for moving said carrier along said shaftway between said positions, a vault for receiving a deposit dropped into it from said carrier when said carrier is at said dump position, a barrier which blocks access from said door to said vault, said barrier having an opening to said vault with which said carrier communicates at said dump position, said carrier including a partition which is movable relative to it to displace the deposit from the carrier, through the vault opening, and into the vault, and means for so moving said partition when the carrier is adjacent said dump position.

2. The depository of claim 1 wherein said shaftway is vertical, said carrier is movable longitudinally along said shaftway but not rotationally in it, and is moved up it to said dump position, and said barrier is a wall in which said opening is formed.

3. The depository of claim 1 wherein said barrier is a vertical wall, said carrier is moved upwardly on a linear path parallel to said wall, to said dump position, and said partition moves to displace the deposit laterally through said opening.

4. The depository of claim 3, wherein said carrier is between said door and said barrier, and said barrier is between said carrier and said vault.

5. The depository of claim 1 wherein said carrier is a generally rectangular enclosure and is cantilevered from and moves on a guidepost extending longitudinally in said shaftway.

6. The depository of claim 1 wherein said door is in said housing and said carrier further includes a gate which must also be opened in order to insert a deposit into said carrier.

7. The depository of claim 6 wherein said gate is mounted by said carrier and is pivoted thereto for rotation about a horizontal axis.

8. The depository of claim 1 wherein said door is openable only in response to the reading of an encoded card presented by user.

9. The depository of claim 8 wherein said door is in said housing and wherein said carrier includes a gate which is openable only through said door when the latter is open.

10. The depository of claim 9 wherein said moving means moves said carrier from said insert position to said dump position only if both said door and said gate are closed.

11. The depository of claim 1 further wherein, said carrier is mounted and guided for movement along a post in said shaftway, and said moving means is selectively connectable to said carrier.

12. The depository of claim 1 further wherein said moving means operates said partition so rapidly that said deposit is flipped through said opening, past said barrier, into said vault.

13. The depository of claim 12 further including spring means which is compressed by said moving means as the latter is operating to flip the deposit through the opening, thereby cushioning the operation of said moving means.

14. The depository of claim 1 wherein said carrier has a gate pivotally mounted to it at the front to swing down and out to receive said deposit, said carrier having a floor which is rotatable about a horizontal axis at the rear of said carrier to swing the deposit upwardly and toward said opening, said gate having a curved inner face such that when said floor so rotates, it sweeps across the curved inner face of said gate to clear a deposit therefrom.

15. A depository comprising, a housing, a door, a carrier for receiving a deposit inserted into it through said door, said carrier being movable in a shaftway in said housing, between a deposit insert position in which it is accessible through said door, and a dump position in which it is remote from said door, means for moving said carrier along said shaftway between said positions, a vault for receiving a deposit dropped into it from said carrier when said carrier is at said dump position, a barrier which blocks access from said door to said vault, said barrier having an opening to said vault with which said carrier communicates at said dump position, and means for rotating at least a portion of said carrier when the carrier is adjacent said dump position to move the deposit from the carrier, through the vault opening and into the vault, said portion of said carrier comprising a tray within the carrier, on which a deposit resides when inserted, said tray being swingable from a substantially horizontal rest orientation to a substantially vertical orientation to move a deposit to said opening.

16. The depository of claim 5 further wherein the rotating means is responsive to the position of said carrier for turning said tray to said vertical orientation when said carrier is adjacent said dump position, thereby to move said deposit through said opening, and for returning said tray to its rest orientation when the carrier is returning to the insert position.

17. The depository of claim 15 wherein said tray comprises a floor of said carrier.

18. The depository of claim 15 wherein said tray is hinged to said carrier for rotary movement about a horizontal axis.

19. The depository of claim 18 wherein said door is in said housing, said carrier further includes a gate which must also be opened in order to insert a deposit into said carrier, and said gate has a face toward said tray which conforms to the arc described by said tray when it is rotated to said vertical orientation.

20. The depository of claim 15 wherein said tray is parallel to and closely adjacent said barrier as said carrier is being moved back from said dump position to said insert position, a deposit on said tray thereby being stripped therefrom by an edge presented by said barrier as the carrier moves past said edge toward said insert position.

21. The depository of claim 20 wherein said tray is rotated back to horizontal position only after it has passed said edge of said barrier.

22. The depository of claim 15 further wherein said shaftway is vertical, said moving means comprises a drive which is connectable to said carrier to lift said carrier up said shaftway, and including means disconnecting said moving means from said carrier when said carrier is at said dump position.

23. The depository of claim 22 further wherein said rotating means comprises said drive and means connecting said drive to said tray to rotate the latter to vertical orientation when said carrier is at said dump position.

24. The depository of claim 23 further wherein a cam engages and actuates said rotating means when said carrier is at said dump position, by connecting said rotating means to said moving means.

25. The depository of claim 24 wherein said cam operates a crank mechanism attached to said tray.

26. A depository comprising, a vault having an opening, a passage communicating at one end with said opening, said passage having a door at a position remote from said opening, an enclosed carrier for receiving a deposit inserted into it through said door, said carrier being movable in said passage between a deposit insert position in which it is accessible through said door, and a dump position adjacent said opening, means for moving said carrier along said passage between said positions, and means movable relative to said carrier when the carrier is adjacent said opening, to displace the deposit from the carrier, through the opening and into the vault.

27. A depository comprising, an armored passage, a carrier with a door openable to receive a deposit, said carrier being movable in said passage between a deposit insert position in which said door of said carrier is openable from outside said passage, and a dump position in which said carriage is inaccessible, means for moving said carrier along said passage between said positions, a vault for receiving a deposit dropped into it from said carrier when said carrier is at said dump position, said vault having an opening to said passage, said carrier communicating with said opening only at said dump position, and means for rotating at least a portion of said carrier when the carrier is at said dump position to move the deposit from the carrier, through said opening and into the vault.

* * * * *